United States Patent [19]

Chang

[11] Patent Number: 5,064,124

[45] Date of Patent: Nov. 12, 1991

[54] MEDICAL WASTE DISPOSAL SYSTEM

[76] Inventor: Wu-Shan Chang, No. 131, O-Mei St., Taipei City, Taiwan

[21] Appl. No.: 654,816

[22] Filed: Feb. 13, 1991

[51] Int. Cl.[5] ..... B02C 19/12

[52] U.S. Cl. ..... 241/33; 241/60; 241/62; 241/99

[58] Field of Search ..... 241/99, 79.1, 33, 62, 241/60

[56] References Cited

U.S. PATENT DOCUMENTS

| | | | |
|---|---|---|---|
| 3,386,668 | 6/1968 | Shepherd | 241/62 X |
| 3,926,379 | 12/1975 | Dryden et al. | 241/99 X |
| 4,269,364 | 5/1981 | Monconi et al. | 241/99 X |

FOREIGN PATENT DOCUMENTS

| | | | |
|---|---|---|---|
| 3829380 | 3/1990 | Fed. Rep. of Germany | 241/99 |

*Primary Examiner*—Mark Rosenbaum
*Assistant Examiner*—Frances Chin
*Attorney, Agent, or Firm*—Ladas & Parry

[57] ABSTRACT

A disposal system for the grinding, sorting, and sanitization of medical waste with sanitizing liquid includes a hollow housing. The hollow housing includes a grinding device to grind the medical waste, a receiving device to receive and sort the ground medical waste into lighter and heavier fragments and sanitize the same. The receiving device is pivotally mounted in the housing so as to be rotated outwards therefrom. The housing includes a returning device and a discharging device for respectively returning and discharging the sanitizing liquid. The housing includes an electrical control device to activate the grinding device, the receiving device, the returning device and the discharging device.

6 Claims, 6 Drawing Sheets

MEDICAL WASTE DISPOSAL SYSTEM

FIELD OF THE INVENTION

This invention relates to a disposal system, more particularly to a disposal system for the grinding, sanitization, and sorting of medical waste.

DESCRIPTION OF RELATED ART

It is general practice in the medical community for medical waste, such as used needles and syringes, as well as testing vials, to be thrown into a conventional disposal systems for grinding. The conventional disposal system does not sanitize and sort the waste. Medical waste, unclassified by weight or other characteristics, hampers subsequent safe disposal of the rest of the waste. Ground medical waste which is not sanitized and is disposed in landfills and such can result in environmental contamination. Sorting and sanitization of medical waste by labor intensive means, is expensive.

SUMMARY OF THE INVENTION

Therefore, the object of this invention is to provide a disposal system for the grinding sorting, and sanitization of medical waste. After grinding, sorting, and sanitization by the disposal system, the medical waste is suitable to be disposed by ordinary means without risk of contamination. The disposal system is electrically controlled without extra labor, so as to reduce the disposal cost.

Accordingly, a disposal system with sanitizing liquid for medical waste includes a hollow housing which has a top end, a bottom end, and a side wall interconnecting the two ends. The housing has an entrance for the medical waste with a liquid inlet provided near the top end, and an exit provided at the side wall and near the bottom end. A grinding means for grinding medical waste includes a top inlet portion connected to the entrance of the housing, and a bottom outlet portion. Ground medical waste will include lighter and heavier fragments.

A receiving means provided in the housing includes a first container located under the outlet portion of the grinding means. The first container is pivotally connected to the housing so as to be rotated out of the housing exit. The first container has a top open end, a bottom liquid outlet, a strainer, and a sensor to sense the liquid level. The receiving means includes a second container removably mounted in the first container. The second container has a top open end opening to the outlet portion of the grinding means. The second container receives the liquid, the lighter and the heavier fragments of medical waste. The receiving means further has a means for guiding the liquid and the lighter ground medical waste from the second container into the first container. The guiding means includes means for preventing the lighter fragments of medical waste in the first container from returning into the second container; and a means for communicating the liquid in the first and second containers to maintain equal levels of liquid in the first and second containers.

The housing has means for returning the liquid from the first container to the entrance of the housing; and means for discharging the liquid out from the first container.

An electrical control means is provided in the housing for activating the grinding means for a first predetermined period of time, delivering the liquid from the liquid inlet when the medical waste poured into the entrance of the housing is ground by the grinding means. The electric control means stops the flow of liquid from the liquid inlet and actuates the returning means when the sensor determines that the liquid level in the first container has reached a desired level, and deactivates the returning means when the grinding means is deactivated after the first predetermined period of time. The electrical control means activates the discharging means after when the medical waste has been soaked in the liquid contained in the receiving means for a second predetermined period of time.

BRIEF DESCRIPTION OF THE DRAWINGS

Other features and advantages of this invention will become apparent in the following detailed description of the preferred embodiment with reference to the accompanying drawings, in which.

DETAILED DESCRIPTION OF THE PREFERRED EMBODIMENT

Figure 1:
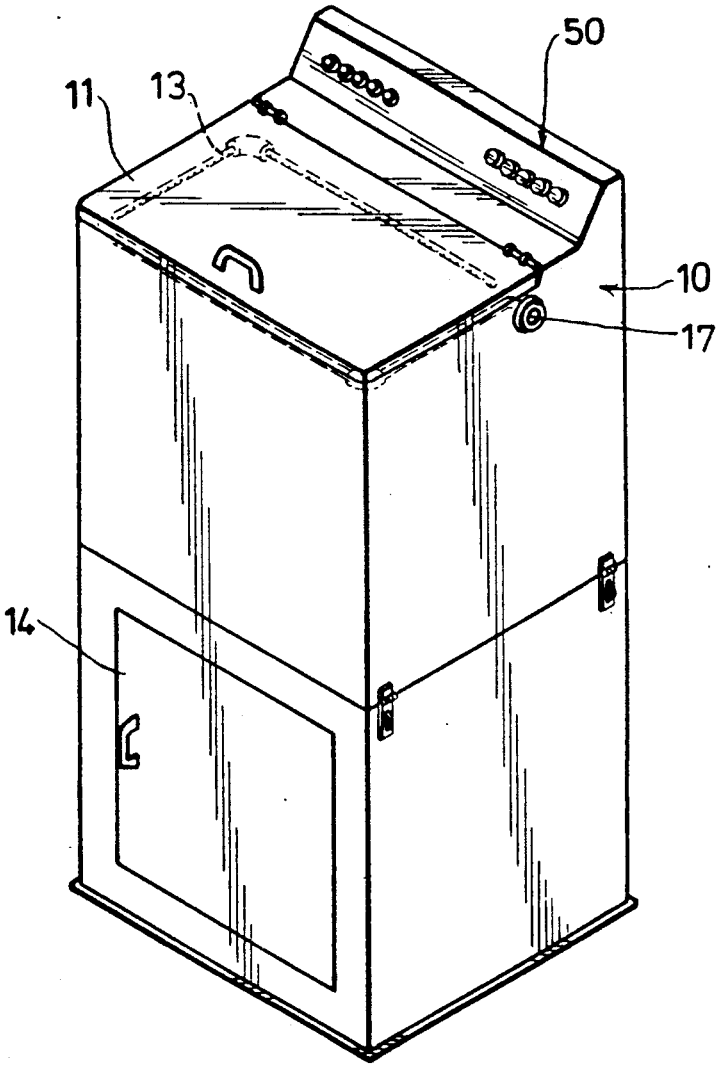
FIG. 1 is a perspective view of a preferred embodiment of a disposal system for medical waste of this invention.
Figure 2:
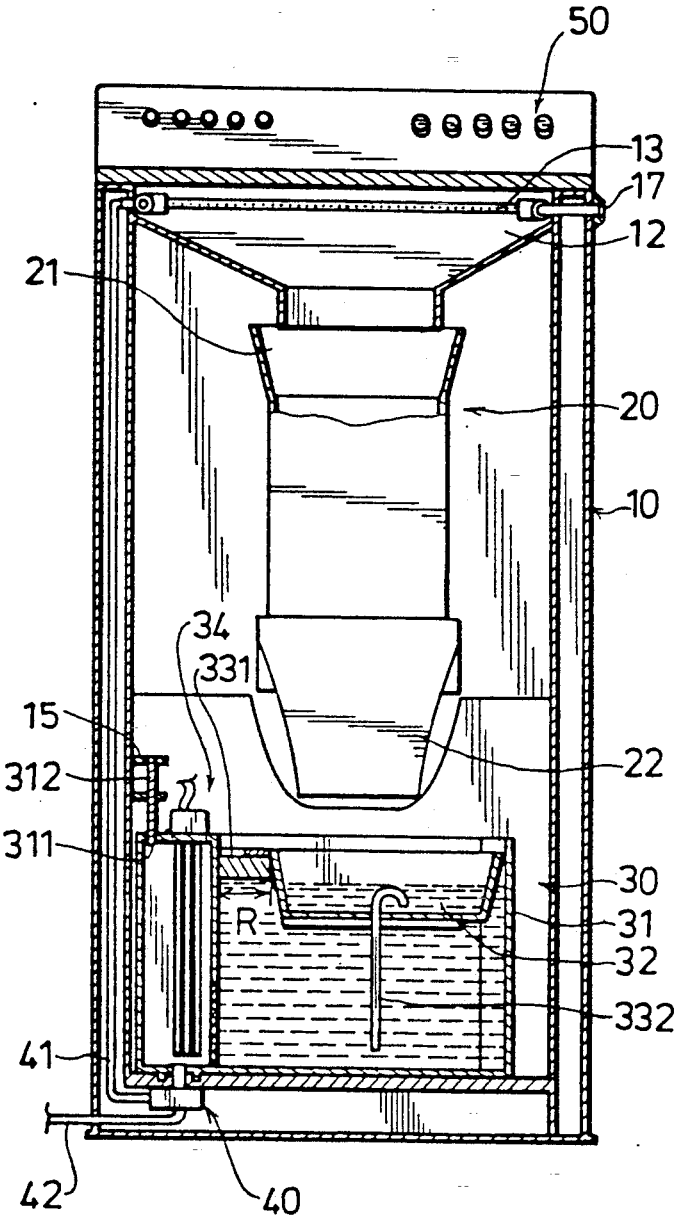
FIG. 2 is a sectional assembled view of the disposal system in FIG. 1.
Figure 3:
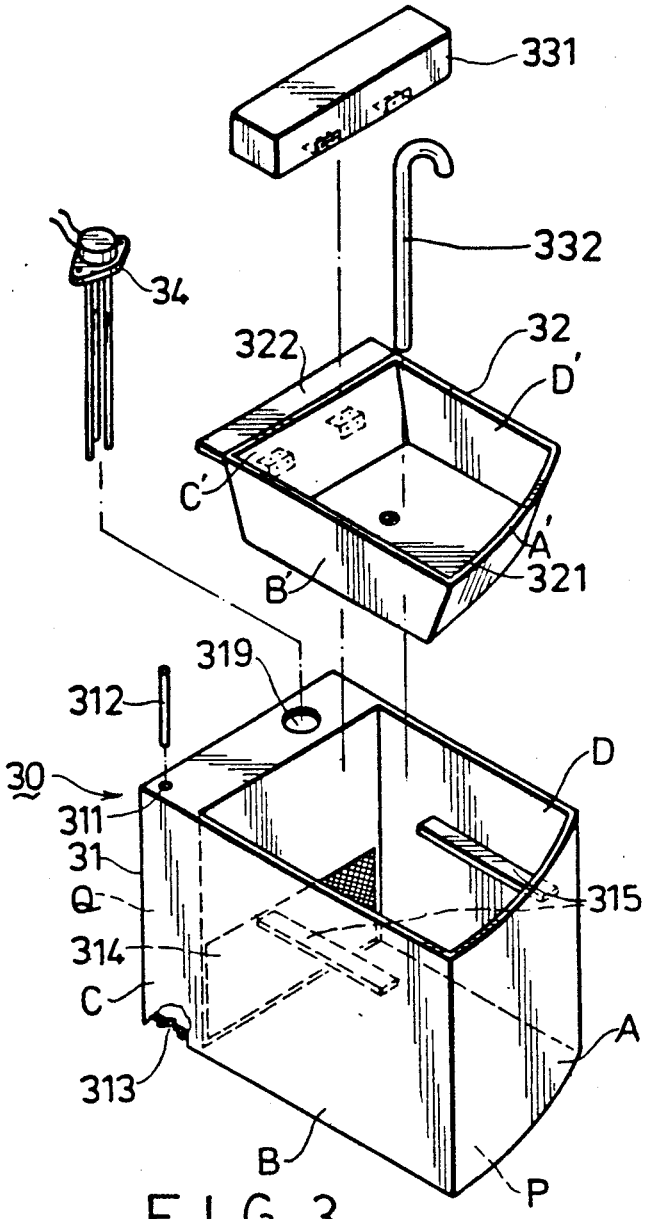
FIG. 3 is an exploded perspective view of the receiving means of the disposal system shown in FIG. 2.
Figure 4:
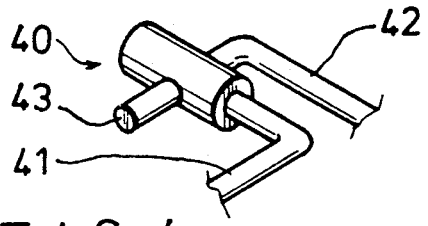
FIG. 4 is a schematic view of the returning and discharging means of the disposal system shown in FIG. 2.

Referring to FIG. 1, a disposal system for grinding, sorting, and sanitization of medical waste with sanitizing liquid for this invention includes a hollow housing 10 which has a top cover 11, a bottom end, and a surrounding side wall with an exit 14. Referring FIGS. 2, 3, and 4, the housing has a funnel-like entrance 12 for medical waste provided under said top cover 11, a liquid inlet pipe 17 with a plurality of spraying holes provided beside one portion of the top inside wall of the funnel-like entrance 12, and an outlet pipe 13 for a returned liquid with a plurality of spraying holes provided beside the other portion of the top inside wall of the funnel-like entrance 12. A grinding means 20 for grinding the medical waste includes a top inlet portion 21 connected to the funnel-like entrance 12, and a bottom outlet portion 22. The ground medical waste includes lighter and heavier fragments after the grinding process is completed.

A receiving means 30 is provided at the bottom end of the housing 10 near the exit 14 for receiving the sanitizing liquid and the ground medical waste. The receiving means 30 includes a first container 31 provided under the outlet portion 22 having a first top open end, a first closed bottom with a liquid outlet 313, and a first surrounding side wall connected to the closed bottom. The first surrounding side wall has an arcuated wall side (A), and three wall sides (B), (C), and (D). The first container 31 has a straining plate 314 vertically disposed therein to separate the same into a first division (Q) and a second division (P). The first division (Q) includes the liquid outlet 313, a pivot pin 312, and a top closed end with a pivot hole 311 and a mounted hole 319. The first container 31 includes a sensor 34 mounted on the mounted hole 319 to sense a level of the liquid in the first container 31. The housing 10 has a pair of plates 15 with two pivot holes thereon extending from the surrounding side wall of the housing 10 near the exit 14. The first container 31 is pivotally connected to the housing 10 by the pivot pin 312 sequently passing through the pivot holes in the pair of plates 15 and the pivot hole 311 of the top closed end of the first division (Q) so as to be rotated out of the exit 14. The first container 31 has a pair of plates 315 respectively extending from the two opposite wall sides, (B) and (D), of the second division (P). The receiving means 30 includes a second container 32 to receive the sanitizing liquid, and the lighter and heavier fragments of medical waste. The second container 32 has a second top open end, a second closed bottom, and a second surrounding side wall which has an arcuated wall side (A'), and three other wall sides, (B'), (C'), and (D'). The second container 32 is removably mounted on the pair of plates 315 in the second division (P) with the second top open end opening to the outlet portion 22 of the grinding means 20. When the second container 32 is mounted in the second division (P), the second top peripheral edge of the second container 32 is located below the first top peripheral edge of the first container 31, the other wall sides (A'), (B'), and (D') are respectively in contact with the wall sides (A), (B), and (C), and a gap (R) is formed between the other wall side (C') and the straining plate 314. A tab 322 extends from the other wall side (C') of the second container 32 for guiding the liquid and the lighter fragments of medical waste from the second container 32 into the first container 31. A float 331 is hinged to the other wall side (C') below the tab 322 and is in its normal downward position. The float 331 can move upwardly to close the gap (R) so that the first top open end of the second division (P) can be completely covered by the float 331 and the second container 32. The tab 322 can prevent the float 331 from moving upwardly out of the position in which the float 331 closes the gap (R), so that the float 331 can prevent the lighter fragments of medical waste in the first container 31 from flowing back in the second container 32. A communicating pipe 332 has a top open end extending into the second container 32 above the second bottom of the same, and a bottom open end extending into the first container 31 for maintaining the liquid in the first and second containers, 31 and 32, at equal levels.

A returning and discharging means 40 includes a returning device 41 for returning the liquid from the first container 31 to the funnel-like entrance 12 of the housing 10, a discharging device 42 for discharging the liquid from the first container 31, and a connection portion 43 connected to the liquid outlet 313 of the first container 31.

An electrical control means 50 provided in the housing 10 activates the grinding means 20 for a first predetermined period of time. Medical waste poured into the funnel-like entrance 12 of the housing 10 is ground by the grinding means 20, the electrical control means 50 then delivers the liquid from the liquid inlet pipe 17 to the funnel-like entrance 20. The electrical control means 50 stops the flow of liquid from the liquid inlet pipe 17, and actuates the returning device 41 when the sensor 34 determines that the liquid level in the first container 31 has reached a desired level. The electrical control means 50 deactivates the returning device 41 when the grinding means 20 is deactivated after the first predetermined period of time. The control means 50 also activates the discharging device 42 when the medical waste is soaked in the liquid contained in the receiving means 30 after a second predetermined period of time.

Figure 5:
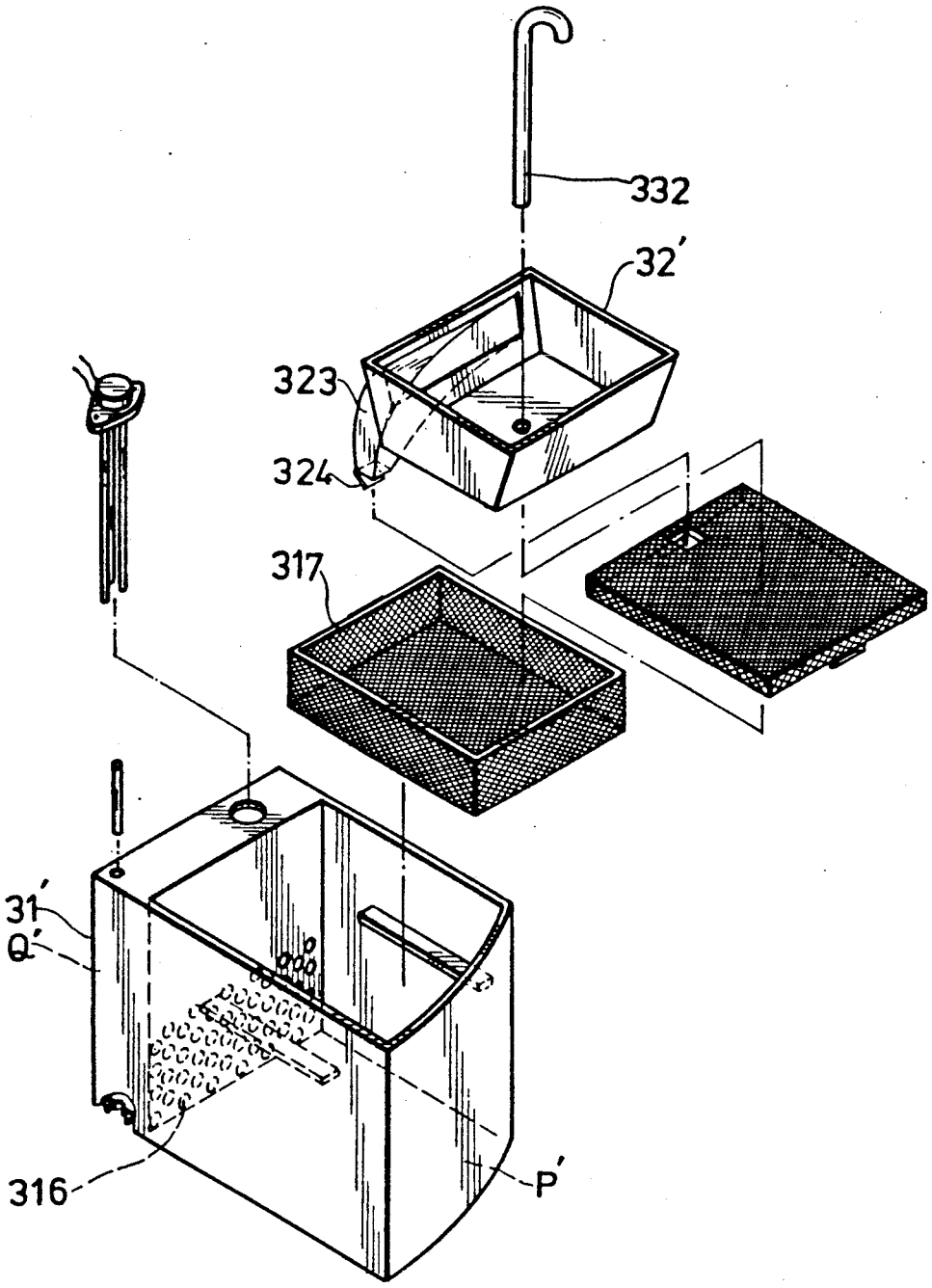
FIG. 5 is an exploded perspective view of the second preferred embodiment of the receiving means of the disposal system of this invention.

Referring to FIG. 5, a second receiving means is similar to the first receiving means described above. The first container 31' has a plate 316 with a plurality of perforated holes vertically disposed therein to separate the first container 31' into a first division (Q'), and a second division (P'). The second division (P') has a closed straining case 317 with an inlet provided under the second container 32'. The wall side (CC') of the second container 32' has an opening formed between the second top peripheral edge and the second closed bottom. A conduit 323 extends outwardly and downwardly from the wall side (CC'). The conduit 323 has a top end connected to the opening of the second container 32', and a bottom end with a check valve 324 connected to the inlet of the closed straining case 317.

Figure 6:
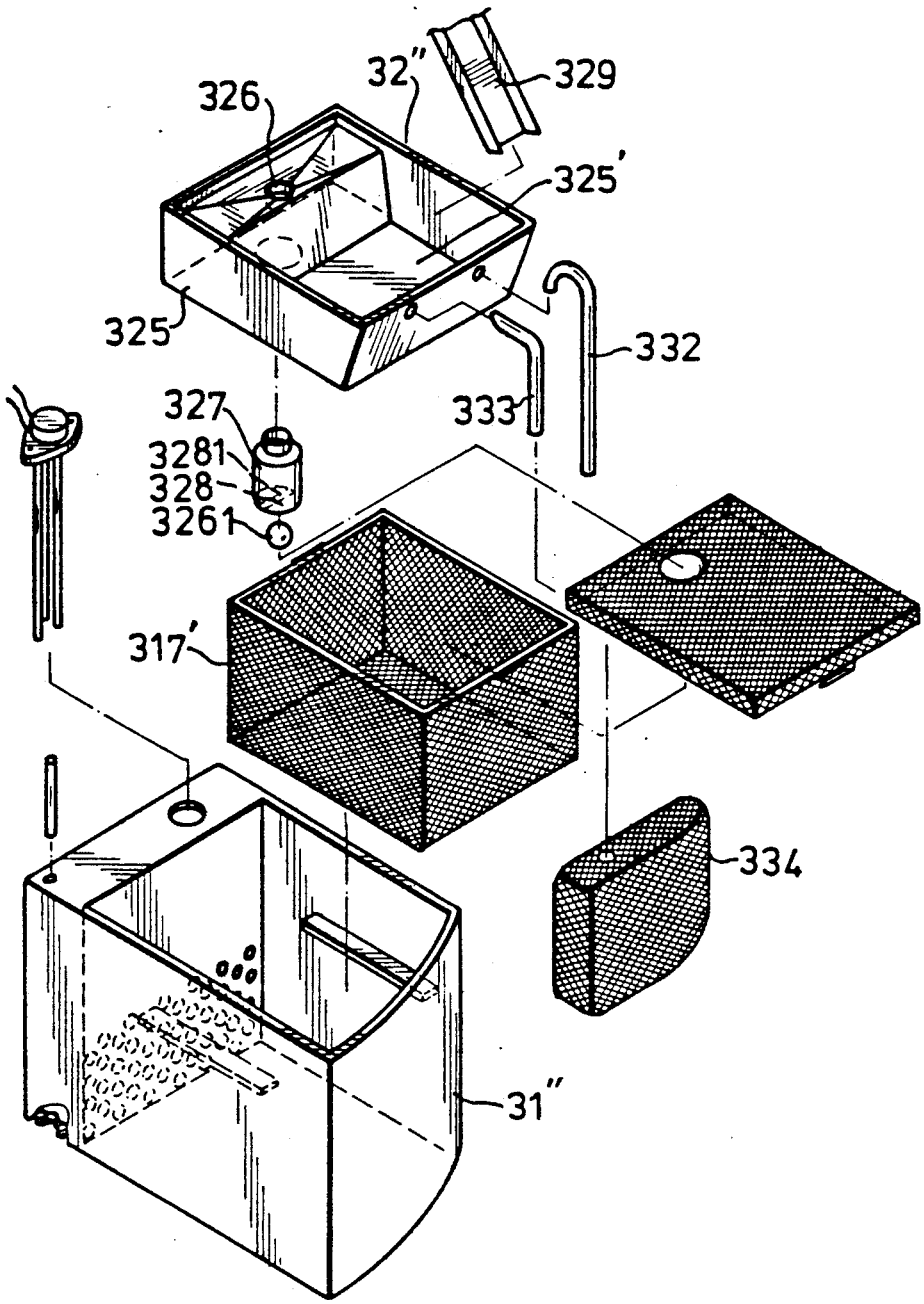
FIG. 6 is an exploded perspective view of a third preferred embodiment of the receiving means of the disposal system of this invention.
Figure 6A:
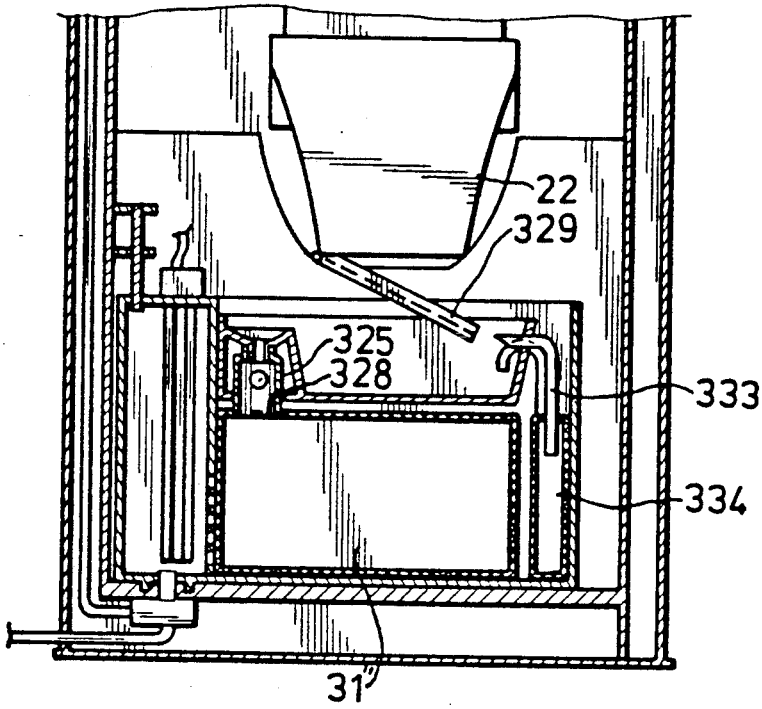
FIG. 6(A) is a partial sectional view of the disposal system of this invention having the receiving means shown in FIG. 6.
Figure 6B:
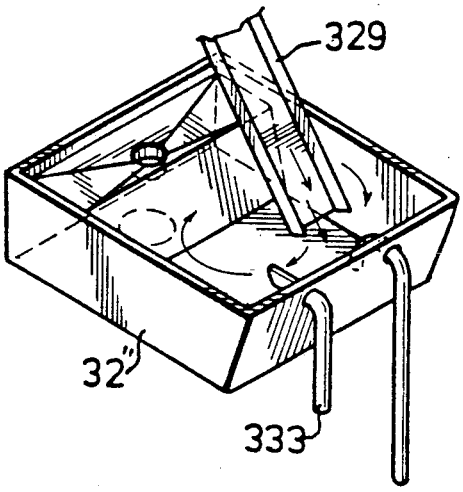
FIG. 6(B) is an assembled schematic view of the second container shown in FIG. 6.

A third receiving means shown in FIGS. 6, 6(A), and 6(B) is similar to the second receiving means in FIG. 5. The second container 32'' has a generally vertically disposed plate 400 with a top edge below the second top peripheral edge of the second container 32''. The plate 400 divides the second container 32'' into a first section 325 and a second section 325'. A hopper provided in the first section 325 has a surrounding top edge connected to the plate 400 and the second surrounding side wall of the first section 325, and a discharge opening 326. A hollow discharge housing 327 has a top open end connected to the discharge opening 326, and a bottom open end 328 passing through the second bottom of the second container 32'' and connected to the closed straining case 317'. A float valve 3261 is disposed in the discharge housing 327 to block the discharge opening 326 when the float valve 3261 rises. The bottom open end 328 has a blocking strip 3281 to prevent the float valve 3261 from falling out of the discharge housing 327. The first container 31'' has a second closed straining case 334 therein. The second section 325' of the second container 32'' has a conduit pipe 333 with a top wedged open end provided above the bottom of the second container 32'', and a bottom open end connected to the second straining case 334. A discharge channel 329 has a top end connected to the bottom outlet portion 22 of the grinding means 20, and a bottom end connected to the second section 325' of the second container 32''. When the ground medical waste and the liquid is delivered from the bottom outlet portion 22 of the grinding means 20 to the second section 325' of the second container 32'' by the discharge channel 329, the liquid is whirled around the second section 325' so as to facilitate the complete discharge of the lighter fragments of medical waste from the second container 32''.

After being ground, sorted, and sanitized in the disposal system, the medical waste is suitable to be disposed of without any subsequent waste disposal problem or contamination. The disposal system is electrically controlled without the need for extra labor so as to reduce the cost of the disposal process.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. A disposal system for the grinding, sorting, and sanitization of medical waste with sanitizing liquid, said system comprising:

a hollow housing, which has a top end, a bottom end, and a side wall interconnecting said two ends, having an entrance with a liquid inlet for said medical waste provided near said top end, and an exit provided at said side wall and near said bottom end;

a grinding means for grinding said medical waste disposed in said housing including a top inlet portion connected to said entrance of said housing, and a bottom outlet portion, the ground medical waste including lighter and heavier fragments after being ground;

a receiving means provided in said housing including a first container provided under said outlet portion of said grinding means, said first container pivotally connected to said housing so as to be rotated out of said exit of said housing, said first container having a top open end, a bottom liquid outlet, a strainer therein, and a sensor to determine the level of said liquid contained therein; a second container removably mounted in said first container having a top open end opening to said outlet portion of said grinding means for receiving said liquid, said lighter and heavier fragments of medical waste; means for guiding said liquid and said lighter fragments of medical waste from said second container into said first container including means for preventing said lighter fragments of medical waste in said first container from flowing back said second container; and means for communicating said liquid in said first and second containers to obtain equal levels of liquid in both said first container and said second container;

means for returning said liquid from said first container to said entrance of said housing;

means for discharging said liquid out from said first container;

an electrical control means provided in said housing for activating said grinding means for a first predetermined period of time, delivering said liquid from said liquid inlet to said entrance of said housing when said medical waste poured into said entrance is ground by said grinding means, stopping the flow of said liquid from said liquid inlet to said entrance and activating said returning means when said sensor determines that the liquid level in said first container has reached a desired level, deactivating said returning means when said grinding means is deactivated after the first predetermined period of time, and actuating said discharging means when said medical waste is soaked in said liquid contained in said receiving means after a second predetermined period of time.

2. A disposal system as claimed in claim 1, wherein said first container has a first top open end, a first closed bottom with said bottom liquid outlet, and a surrounding side wall having four wall sides connected to said first closed bottom, said second container having a second top open end, a second closed bottom, and a second surrounding side wall having four wall sides connecting said second closed bottom, said second container being downwardly tapered, said strainer of said first container including a straining plate which is vertically disposed in said first container to separate said first container into a first and a second division, the first division having said bottom liquid outlet of said first container formed therein, the first division having a pair of plates respectively extending from two opposite wall sides of the second division, said second container being removably mounted on said pair of plates in the second division, the second top peripheral edge of said second container being located below said first top peripheral edge of said first container when disposed on said pair of plates, the second top peripheral edge of the three wall sides of said second surrounding side wall or said second container being in contact with the three wall sides of said first surrounding side wall of the second division of said first container, a gap being formed between the fourth wall side of said second surrounding side wall and said straining plate; said guiding means being a tab extending from the fourth wall side of said second surrounding side wall, said preventing means being a float hinged to the fourth wall side of said second surrounding side wall below said tab resting in a normally downward position, said float moving upwardly to close said gap so that said first top open end of said first division of said first container can be covered by said float and said second container, said tab preventing said float from moving upwardly out of the proper position in which said float blocks said gap; said communicating means being a communicating pipe with a top open end provided in said second container above said second bottom of the same and a bottom open end in said first container.

3. A disposal system as claimed in claim 2, wherein said strainer is a closed straining case with an inlet provided under said second container and in said first container, the fourth wall side of said second surrounding side wall of said second container having an opening formed between the second top peripheral edge and said second closed bottom, said guiding means being a conduit extending outwardly and downwardly from the fourth wall side of said second surrounding side wall, said conduit having a top end connected to said opening, and a bottom end with a check valve connected to said inlet of said closed straining case.

4. A disposal system as claimed in claim 1, wherein said second container includes a second closed bottom, and a surrounding side wall connected to said closed bottom, said strainer including a first closed straining case with an inlet provided in said first container under said second container, said second container having a generally vertically disposed plate with a top edge below the second top peripheral edge of said second container, said plate dividing said second container into a first and second section, said guiding means including a hopper and a hollow discharge housing provided in said first section, said hopper having a surrounding top edge connected to said plate and the second surrounding side wall of said first section, and a bottom discharge opening, said discharge housing having a top open end connected to said discharge opening of said hopper, and a bottom open end passing through said second bottom and connected to said inlet of said first straining case; said preventing means including a float valve disposed in said discharge housing to block said discharge opening when said float valve rises; said communicating means including a communicating pipe having a top open end extending into said second section of said second container above said second bottom of the same, and a bottom open end extending into said first container.

5. A disposal system as claimed in claim 4, wherein said strainer includes a second closed straining case provided in said first container beneath said second container, the second section of said second container having a conduit pipe with a top wedged open end provided above said bottom of said second container, and a bottom open end connected to said second straining case.

6. A disposal system as claimed in claim 5, wherein said disposal system includes a discharge channel with a top end connected to said bottom outlet portion of said grinding means, and a bottom end connected to said second section of said second container.

* * * * *